US006955304B2

(12) United States Patent
Beach et al.

(10) Patent No.: US 6,955,304 B2
(45) Date of Patent: Oct. 18, 2005

(54) ANTI-ICING SPRAY ASSEMBLY

(75) Inventors: Michael E. Beach, East Troy, WI (US); Jerry R. Waldman, Castle Rock, CO (US)

(73) Assignee: Energy Absorption Systems, Inc., Chicago, IL (US)

( * ) Notice: Subject to any disclaimer, the term of this patent is extended or adjusted under 35 U.S.C. 154(b) by 73 days.

(21) Appl. No.: 10/679,754

(22) Filed: Oct. 6, 2003

(65) Prior Publication Data

US 2005/0072859 A1 Apr. 7, 2005

(51) Int. Cl.[7] ..... B05B 17/00; B05B 15/06; B05B 15/10; B05B 3/00; A01G 25/06

(52) U.S. Cl. ..... 239/1; 239/200; 239/201; 239/207; 239/600

(58) Field of Search ..... 239/1, 200, 201, 239/207, 600, 202, 569, 596, DIG. 1; 169/5, 16, 17, 51, 54

(56) References Cited

U.S. PATENT DOCUMENTS

| | | | | |
|---|---|---|---|---|
| 3,540,655 A | | 11/1970 | Hinrichs | |
| 4,945,675 A | | 8/1990 | Kendrick | |
| 5,207,499 A | | 5/1993 | Vajda et al. | |
| 5,447,272 A | | 9/1995 | Ask | |
| 6,035,887 A | | 3/2000 | Cato | |
| 6,047,897 A | * | 4/2000 | Ueno et al. | 239/1 |
| 6,082,638 A | | 7/2000 | Ask et al. | |
| 6,102,306 A | | 8/2000 | Ask et al. | |
| 6,126,083 A | | 10/2000 | Boschung et al. | |
| 6,182,767 B1 | * | 2/2001 | Jackson | 169/16 |
| 6,270,020 B1 | | 8/2001 | Thompson et al. | |
| 6,443,176 B1 | | 9/2002 | Waterson | |
| 6,450,731 B1 | | 9/2002 | Bohnhoff | |

FOREIGN PATENT DOCUMENTS

| | | |
|---|---|---|
| EP | 0 461 295 A1 | 12/1991 |
| EP | 0 461 295 B1 | 2/1994 |

OTHER PUBLICATIONS

Surface Systems, Inc., "RWIS Overview," http://www.ssi-weather.com/wintermenu.asp?citem=1, p. 1 of 1, dated Jul. 30, 2003.

(Continued)

*Primary Examiner*—David A. Scherbel
*Assistant Examiner*—Darren Gorman
(74) *Attorney, Agent, or Firm*—Brinks Hofer Gilson & Lione

(57) ABSTRACT

An anti-icing spray assembly includes a base housing having a generally open top and a cavity. The base housing is adapted to be mounted in a roadway. A spray housing is removably secured to the base housing with at least a portion of the spray housing being disposed in the cavity of the base housing. The spray housing defines an interior chamber and is watertight so as to substantially prevent water from entering the interior chamber. The spray housing includes at least one spray outlet adapted to spray an anti-icing agent onto the roadway. At least one valve assembly is disposed in the interior chamber of the spray housing. The valve assembly is operably connected to the at least one spray outlet. The valve assembly is moveable between a closed position and an open position, wherein the valve assembly is adapted to permit the flow of the anti-icing agent through the at least one spray outlet and onto the roadway when moved to the open position. An anti-icing spray system includes a plurality of anti-icing spray assemblies installed in a roadway having a surface. A fluid conduit communicates with and supplies an anti-icing agent to the respective spray assemblies. A method of installing an anti-icing spray system in a roadway includes installing a plurality of base housings in the roadway such that the base housings do not protrude above a surface thereof, inserting a plurality of spray housings into corresponding ones of the base housings and removably securing the plurality of spray housings to the base housings.

33 Claims, 7 Drawing Sheets

OTHER PUBLICATIONS

Surface Systems, Inc., "SSI Sensing the Future®: FP2000® Surface Sensor," http://www.ssiweather.com/wintermenu.asp?citem=3, pp. 1–3, dated Jul. 30, 2003.

freezefree product, "FreezeFree™ Nitro System: Winner of the 2002 Better Roads Top Rollout Award," http://www.energyabsorption.com/products/freezeFree/freezefree_nitro_system.htm, p. 1 of 2, dated Feb. 24, 2003.

freezefree product, "FreezeFree™ Basic System," http://www.energyabsorption.com/products/freezeFree/freezefree_basic_system.htm, pp. 1–2, dated Feb. 24, 2003.

TMS 2000, "boschung: Thawing Agent Spray System Thawspray TMS 2000," http://www.boschung.com/prod02.htm, pp. 1–2, dated Feb. 20, 2003.

TMS 2000, "Thawspray: Stationary De–icing Service," boschung mecatronic brochure, 4 pages, Boschung Company, Inc., date unknown.

MTS, "Mini Thawing Agent Spray System," Boschung Mecatronic AG brochure, 4 pages, Boschung Company, Inc., date unknown.

Boschung America, LLC, "F.A.S.T.: Fixed Automated Spray Technology," http://www.boschungamerica.com/fast_ins.html, p. 1 of 1, dated Apr. 7, 2003.

Boschung America, LLC, "F.A.S.T.: Fixed Automated Spray Technology," http://www.boschungamerica.com/fast_spr.html, p. 1 of 1, dated Apr. 7, 2003.

International Search Report in corresponding PCT Application No. PCT/US04/29017, dated Jul. 14, 2005, 3 pages.

Written Opinion of the International Searching Authority in corresponding PCT Application No. PCT/US04/29017, dated Jul. 14, 2005, 4 pages.

* cited by examiner

ANTI-ICING SPRAY ASSEMBLY

BACKGROUND

The present invention relates to an anti-icing spray assembly and system, and in particular, to an anti-icing spray assembly that includes a watertight spray housing mounted in a base housing.

Various spray systems have been developed to apply anti-icing or anti-icing agents onto various roadways, including highways and airport runways. In some spray systems, as shown for example in U.S. Pat. Nos. 6,102,306 and 6,126,083 and European Patent No. EP 0 461 295 B1, a plurality of spray heads or nozzles are embedded in the roadway and are flush therewith such that the spray head or nozzle does not interfere with vehicles traveling on the roadway and is not easily damaged thereby. Often, such systems have one or more centrally located valves controlling the discharge of anti-icing agent to a plurality of spray heads. As such, individual spray heads cannot be independently controlled to apply anti-icing agent.

In addition, flush-type spray heads are typically installed directly in the roadway, for example at the time the roadway pavement is poured or applied, or by way of various adhesives or bonding agents. However, if one or more components of the spray head becomes damaged, the spray head typically has to be removed, which can be difficult and expensive. Alternatively, the spray head, if defective or damaged, must be serviced on-sight, which can be difficult in inclement conditions and can disrupt the flow of traffic, whether vehicular or air.

SUMMARY

Briefly stated, in one preferred embodiment described below, an anti-icing spray assembly includes a base housing having a generally open top and a cavity. The base housing is adapted to be mounted in a roadway. A spray housing is removably secured to the base housing with at least a portion of the spray housing being disposed in the cavity of the base housing. The spray housing defines an interior chamber and is watertight so as to substantially prevent water from entering the interior chamber. The spray housing includes at least one spray outlet adapted to spray an anti-icing agent onto the roadway. At least one valve assembly, otherwise referred to as a valve, is disposed in the interior chamber of the spray housing. The valve assembly is operably connected to the at least one spray outlet. The valve assembly, or valve, is moveable between a closed position and an open position, wherein the valve assembly is adapted to permit the flow of the anti-icing agent through the at least one spray outlet and onto the roadway when is moved to the open position. In one preferred embodiment, the base housing is configured as an FAA approved L-868 light base housing.

In another aspect, an anti-icing spray system includes a plurality of anti-icing spray assemblies installed in a roadway having a surface. A fluid conduit communicates with and supplies an anti-icing agent to the respective spray assemblies.

In yet another aspect, a method of installing an anti-icing spray system in a roadway includes installing a plurality of base housings in the roadway such that the base housings do not protrude above a surface thereof, and inserting a plurality of spray housings into corresponding ones of the base housings, with at least a portion of the spray housings being received in the cavities of the corresponding base housings. The method further includes removably securing the plurality of spray housings to the base housings.

The anti-icing assembly, system and method of installation provide significant advantages over other anti-icing devices and systems. For example, each spray assembly can be individually controlled by way of the at least one valve located in the spray assembly. In this way, the spray pattern developed by a plurality or grid of spray assemblies can be quickly and easily programmed and changed for a particular roadway depending on the existing conditions at any particular time.

In addition, by providing a base housing separate from the spray housing, the spray housing, and the various components disposed therein, can be easily removed and replaced with another spray unit, without having to troubleshoot or disassemble the unit on location. Instead, a defective or damaged unit can be taken offsite and can be evaluated and worked on in controlled conditions. At the same time, the watertight spray housing, protects the components located therein. Moreover, in one preferred embodiment, wherein the base housing is configured as an approved FAA light base, the system does not have to be independently evaluated to determine its suitability for use on runways, since the light base, which absorbs the loading from the airplane tires via the spray plate, is approved for such use.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
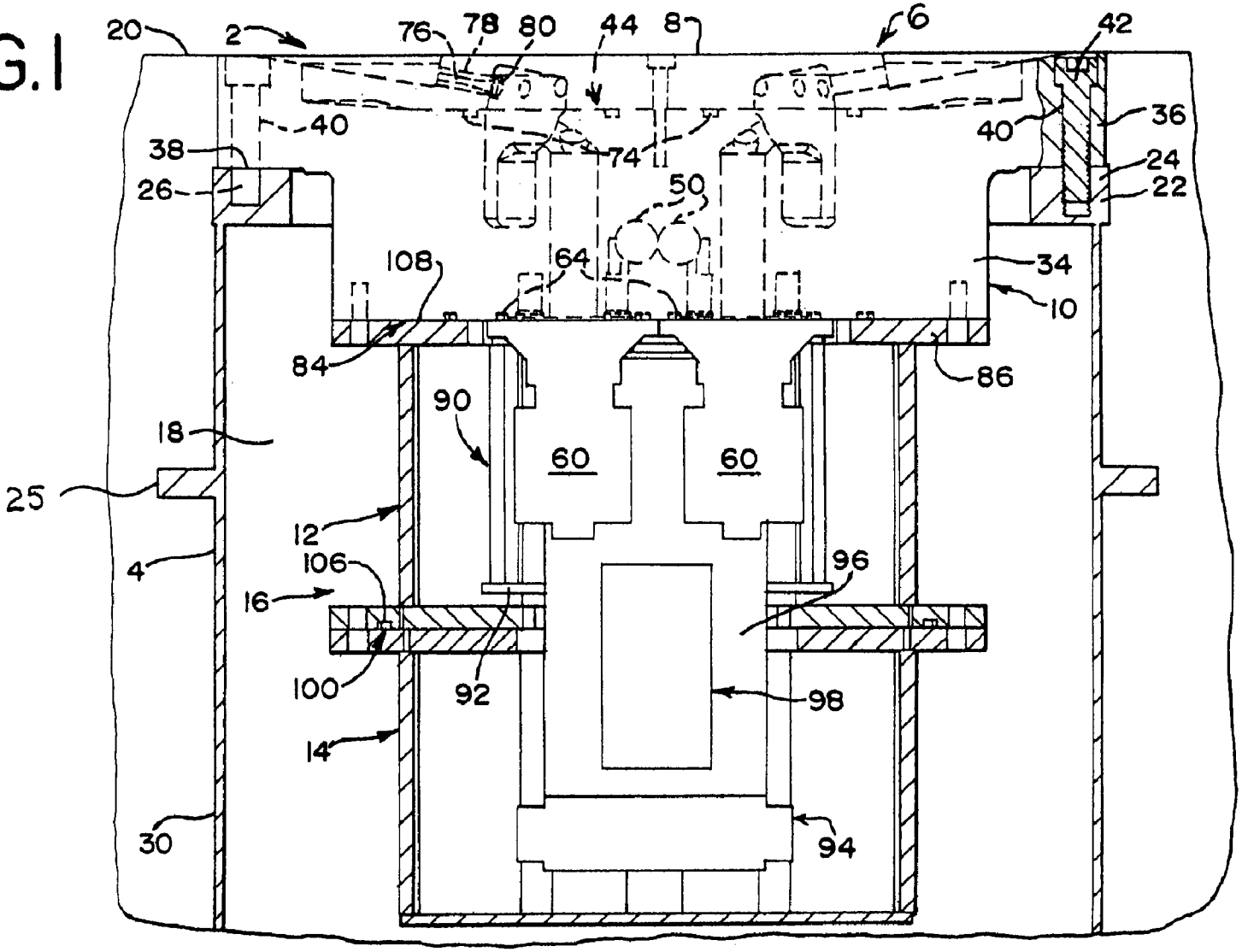
FIG. 1 is an elevated partial, cross-sectional view of an anti-icing spray assembly.

Referring to FIGS. 1 and 6–9, an anti-icing spray assembly 2 includes a base housing 4 and a spray housing 6. It should be understood that the terms "anti-icing" and "anti-icing agents" refer to various agents, such as chemical formulations, that are capable of anti-icing, i.e., capable of preventing the formation of ice, and/or may be capable of de-icing, i.e., capable of melting ice that has already been formed. Some examples of anti-icing agents, usually in the form of fluids, are calcium chloride, magnesium chloride, well brine and potassium acetate. In airport environments, potassium acetate is particularly suitable due to its minimal chemical reaction with aluminum, which is often used for aircraft structures.

The spray housing 6 preferably includes three housing components: (1) a spray plate 8, (2) a support housing 10 and (3) a control housing 16. The control housing 16 includes an intermediate enclosure 12 and an end enclosure 14 or cap. The spray housing 6 is shaped and sized such that at least a portion of the spray housing fits inside a cavity 18 formed in the base housing. In one preferred embodiment, the base housing is a commercially available light base that is approved for installation on airport runways. For example, one suitable base housing is the L-868 light base housing available from Flight Light Inc., having a place of business at 3513 La Grande Blvd., Sacramento, Calif., 95823-1010.

Figure 10:
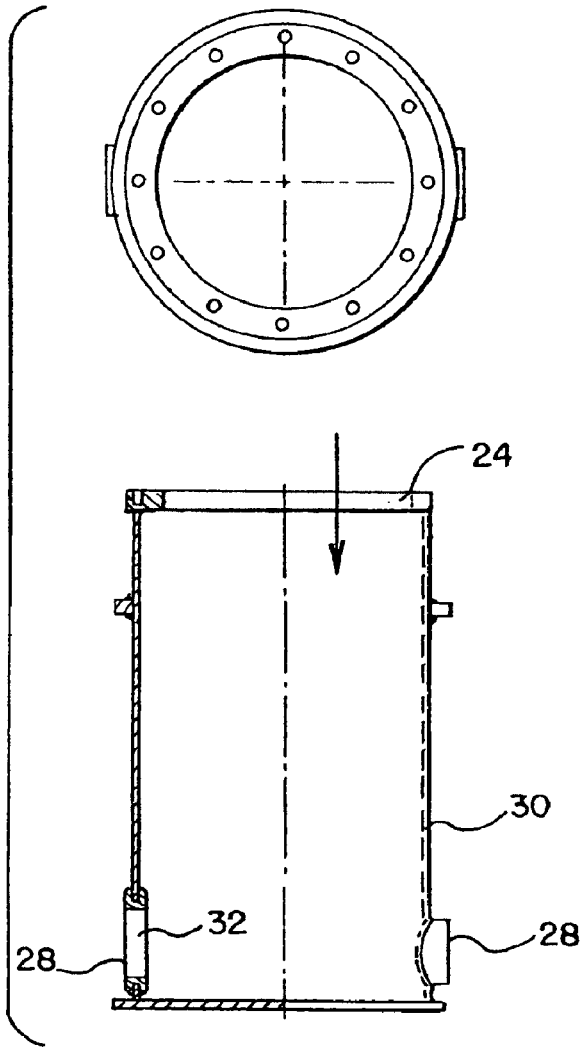
FIG. 10 is an elevated, cross-sectional view of a base housing.
Figure 12:
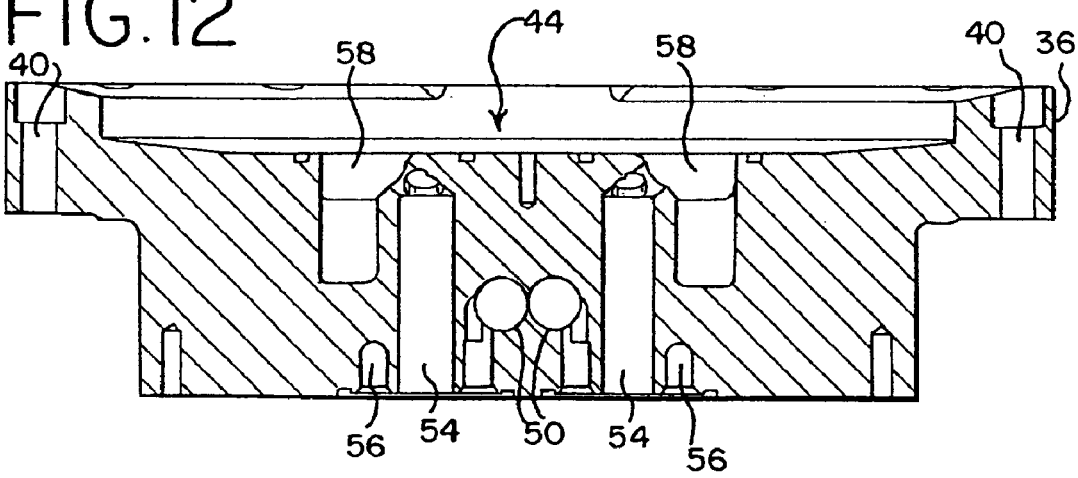
FIG. 12 is a cross-sectional view of the support housing.

Referring to FIGS. 1 and 10, the base housing 4 is disposed or mounted in an opening formed in a roadway 20. The term "roadway" means any surface suitable for supporting vehicular and pedestrian traffic, including without limitation parking lots, streets, highways, bridges, access roads and driveways, airport runways and taxiways, and footpaths. The base housing 4 has a generally open top 22 and defines a cavity 18 therein. The base housing 4 further includes an annular flange 24 or support rim formed on the top thereof A plurality of threaded openings 26 are formed through or in the flange 24. A flange 25 is formed on and extends laterally, radially outward from the sidewall to serve as an anchor, which prevents the base from walking out of the ground during freeze/thaw cycles. A plurality of openings 28 are formed in a sidewall 30 of the base housing adjacent a bottom thereof and communicate with the cavity. A grommet 32 can be provided at one or both of the openings. In one embodiment, a fluid conduit and an electrical conduit (not shown) are inserted through two or more of the openings and include a connector.

Referring to FIGS. 1, 4, 5 and 12, the support housing includes a cylindrical body portion 34 and an annular flange 36 that extends radially outward and fits over the top of the base housing and is sealed against the rim 24 thereof with a gasket 38 disposed therebetween. The support housing is preferably made of metal, including for example and without limitation 6061 Aluminum or A356 cast aluminum, or alternatively hard plastic. The flange 36 has a plurality of holes 40 formed therethrough and arranged in a pattern mating with the holes 26 formed in the base housing rim. "Plurality" as used herein means two or more. A plurality of fasteners 42 are used to removably secure the spray housing 6 to the base housing 4 in a substantially watertight relationship. The term "watertight" means to substantially prevent water from entering or passing through a particular component or joint between components. It should be understood that the spray housing, e.g., the support housing, and the base housing can alternatively be connected by way of adhesives, clamps, snap-fit, tabs, friction fit, etc., or alternatively, that the spray housing simply rests on top of the base housing. A component is considered "watertight" even if it has openings formed therethrough if those openings will be sealed, filled or plugged during the normal course of operation or use, e.g., by way of an electrical or fluid conduit.

Referring to FIGS. 1, 3–7 and 12, the support housing has a recess 44, preferably circular, formed in a top thereof. The support housing 10 includes an inlet port 46 connected to a fluid conduit or supply line 48, which in turn is connected to the fluid conduit extending into the base housing cavity 18. The support housing preferably includes a single inlet port, which reduces the number of plumbing connections, although it should be understood that additional inlet ports can be provided to communicate individually with one or more valves. Preferably, the single inlet port 46 communicates with a pair of valve inlets 50 formed in the body portion of the housing.

Figure 6:
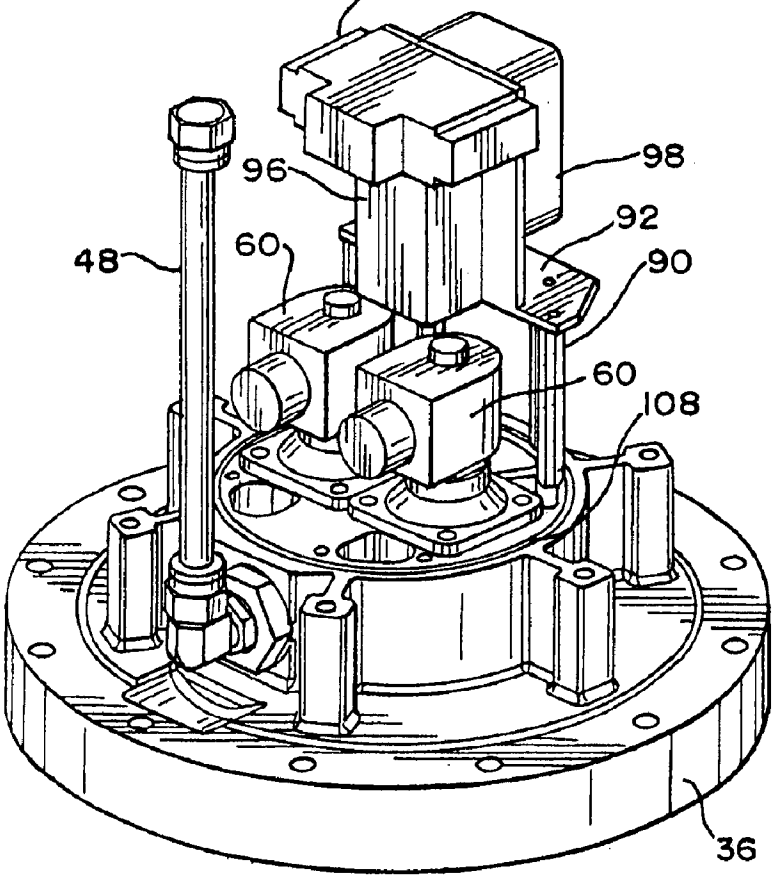
FIG. 6 is a bottom perspective view of a partial assembly of the spray housing including a pair of valve assemblies and an electrical control system connected to the support housing.

A pair of valve ports 52, formed as recessed cylinders, are provided on the bottom of the support housing. The valve ports 52 define an inner fluid passageway 54 that communicates with a pair of sumps 58 (otherwise referred to as valve cavities), which are separated by a center wall 68, and an outer well 56 that communicates with the valve inlets 50. It should be understood that a single valve cavity can be provided, or more than two valve cavities, depending on the number of controlled spray outlets that are desired. Referring to FIG. 6, a pair of valve assemblies 60, preferably configured as solenoid valves, each have a flange or mounted to a bottom of the support housing with a plurality of fasteners (e.g., four), and with a seal 64, such as a #2-133 O-ring, disposed between the housing and the valve bottom. One suitable valve is a Parker #08F22C2140ADF4C05 valve available from Parker Hannifin Corp., Cleveland Ohio. The valves 60 are connected to the support housing 10 over the valve ports and, in response to the solenoid being energized, are moveable between closed and open positions to control the flow of fluid from the valve inlet 50 to the outer well 56, through the valve 60, into the passageway 54, and into the sumps or valve cavities 58. It should be understood that the reference to the valve assembly or valve being "moveable" means that components within the valve are moveable between the closed and open positions to prevent or permit respectively the movement of fluid through the valve, and not that the overall valve assembly or valve itself, i.e., the housing, is moveable relative to the support housing.

Figure 2:
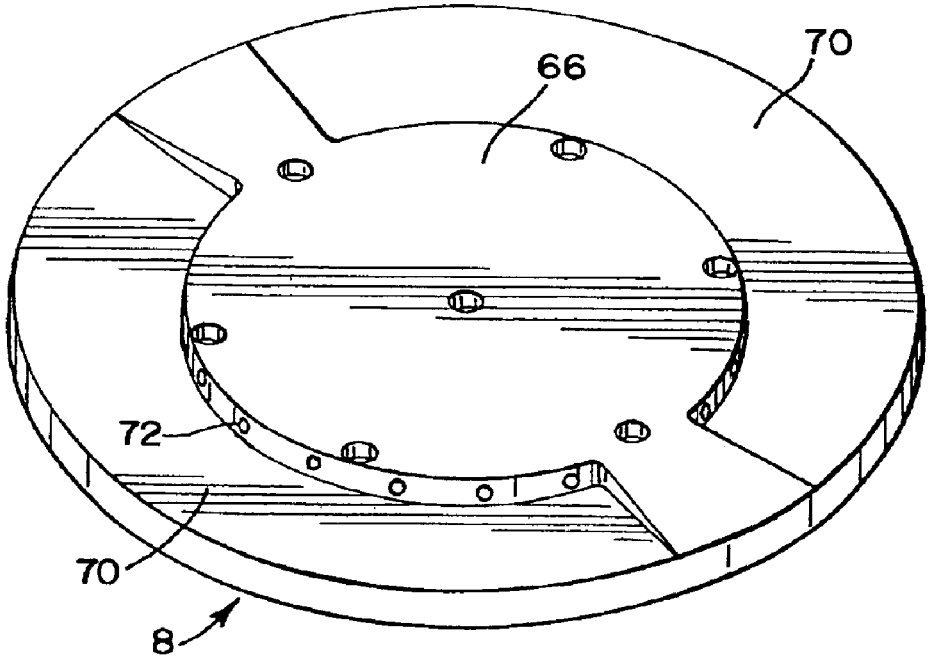
FIG. 2 is a top perspective view of a spray plate.
Figure 3:
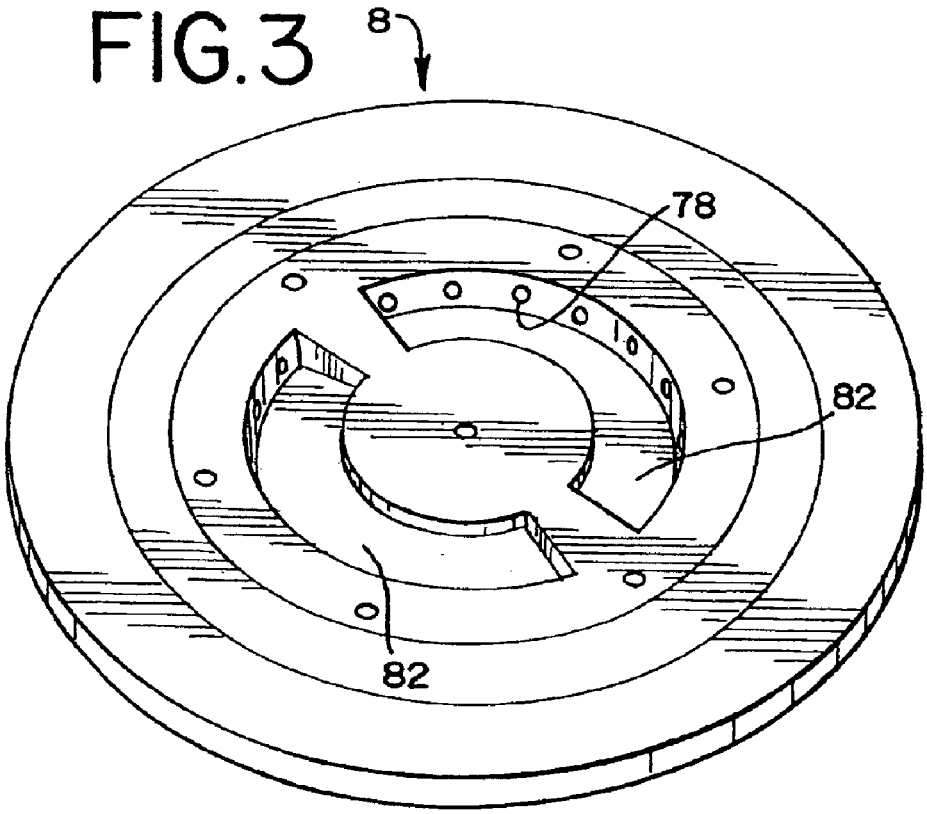
FIG. 3 is a bottom perspective view of the spray plate shown in FIG. 2.
Figure 4:
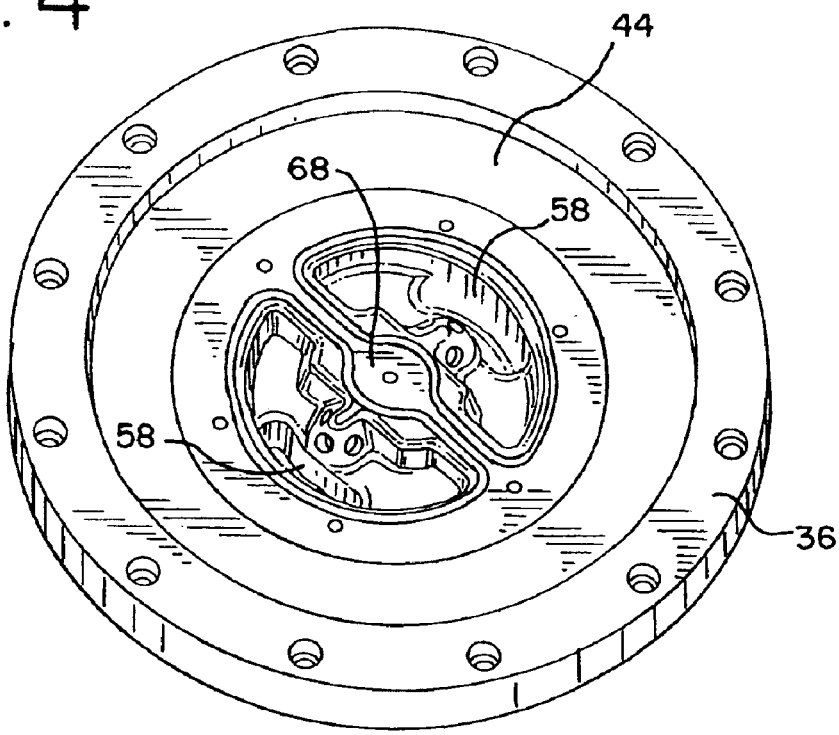
FIG. 4 is a top perspective view of a support housing.
Figure 5:
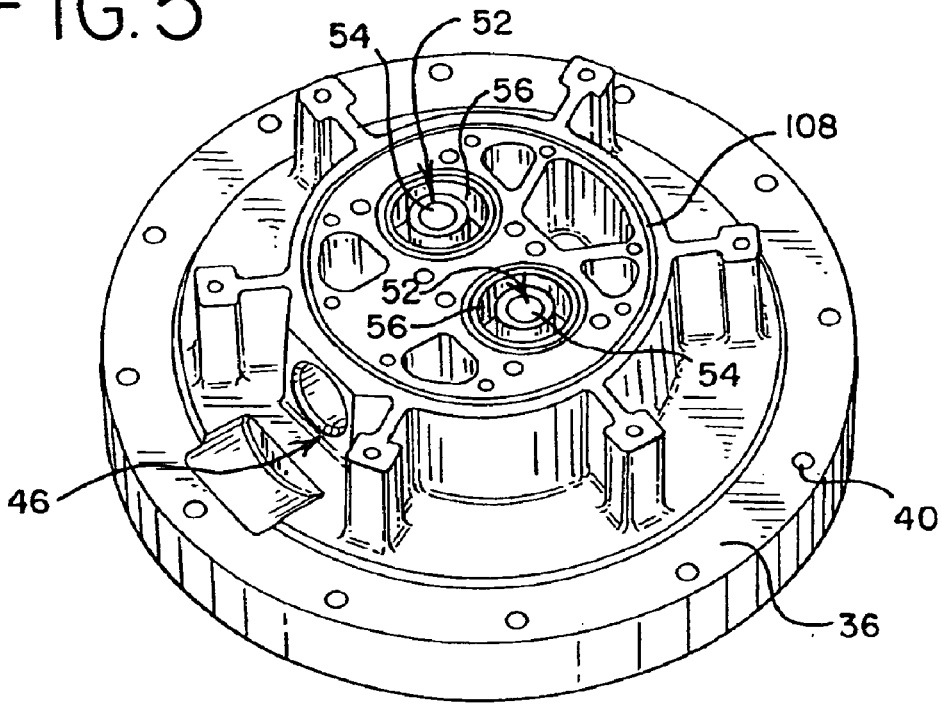
FIG. 5 is a bottom perspective view of the support housing shown in FIG. 4.
Figure 7:
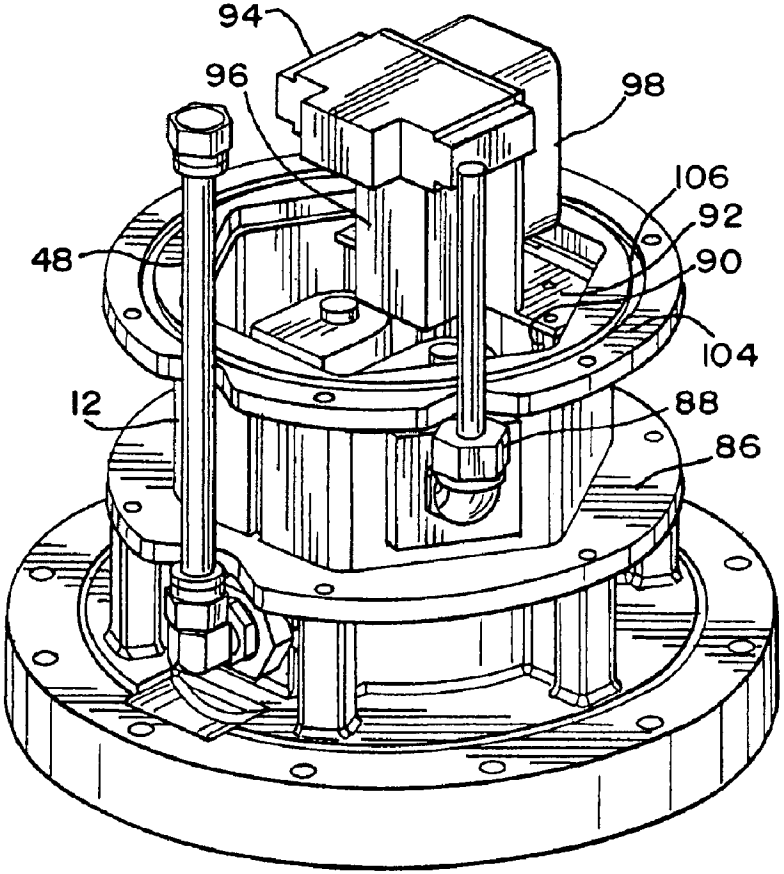
FIG. 7 is a bottom perspective view of a partial assembly of the spray housing including a pair of valve assemblies and an electrical control system and an intermediate housing connected to the support housing.

Referring to FIGS. 1–3, the spray plate 8 is shaped to be received in the recess 44 formed in the support housing. In one preferred embodiment, the spray plate includes a middle portion 66 that has an upper surface substantially flush with the roadway surface so as to not interfere with traffic and to facilitate snow removal. The spray plate 8 is preferably circular and has two spray outlets 70 separated by the middle portion. The spray outlets are configured as recessed banks of spray ports 72, each separately supplied from one of the valve cavities formed in the support housing. Of course, it should be understood that the spray plate can be configured with a single recessed bank, or more than two banks. In one preferred embodiment, the pair of banks 70 face in opposite directions. In other embodiments, three outlets or banks are face in directions spaced at substantially 120 degrees, four outlets or banks face in directions spaced at substantially 90 degrees, and so on. A pair of seals 74, preferably #2-155 o-rings, are disposed between a bottom of the plate and the support housing to form a watertight seal therebetween. A plurality of screws (e.g., seven) secure the spray plate to the support housing. In addition, one or more threaded openings (not shown) can be provided to receive jack screws that can be engaged against the support housing to the remove the spray plate. The spray plate is preferably made of a metal, such as 6061 Aluminum plate, A356 cast aluminum, and/or stainless steel, and/or alternatively is made of plastic.

A plurality of nozzle inserts 76 are installed in a corresponding plurality of passageways 78 formed in the spray plate and communicate with the spray banks of the spray plate. The nozzle inserts 76, and the number thereof, can be configured to provide various spray patterns. The nozzle inserts are replaceable components that communicate the passage of fluid from the valve cavities to the spray outlet. The inserts have a head 80 that is retained in the spray plate and that communicates with a pair of recessed cavities 82 formed in the bottom of the spray plate, which in turn overlie respectively the valve cavities 58. In one preferred embodiment, the nozzle inserts 76 are made of brass or stainless steel. In one embodiment, the inserts are secured to the spray plate using Loctite® retaining compound. The shape and size of an orifice formed through the nozzle insert controls the amount of fluid to be dispersed and the shape of the spray pattern of the individual insert. In one exemplary embodiment, the orifice has an inner diameter of between about 0.00 and about 0.10 inches, and preferably about 0.094 inches. The orifices can be circular or rectangular, which results in a fan spray pattern, or any other desired shape. In some embodiments, blanks or plugs can be inserted in one or more of the plurality of passageways 78 or outlets 72 to further alter and adjust the overall spray pattern.

Referring to FIGS. 1 and 6–9, the intermediate enclosure 12 of the control housing is connected to and sealed against the bottom of the support housing 10 and surrounds the valves 60. A seal 84, preferably a #2-161 o-ring, is inserted into a groove 108 formed on the bottom of the support housing and seals against a mounting flange 86 formed on the intermediate enclosure 12 to form a watertight fit therebetween. The intermediate housing 12 is secured to the support housing 10 with a plurality of fasteners (e.g., six). An electrical conduit or electrical supply line 88, e.g. a watertight cord grip, is secured to the side of the intermediate enclosure in a watertight relationship, preferably at a ½ inch NPT (National Pipe Tap) port. A standoff support 90 is attached to the intermediate enclosure and is connected to a bracket 92 that supports electrical relays 96, a fuse block 94 and terminal blocks 98, which form the electrical control system. These components are connected to and control the solenoid valves as is well known in the art. One suitable relay is the Leviton #6376 addressable relay. Wiring connections are made through the terminal blocks 98. One suitable terminal block is the Allen Bradley #AB-1492-F2 terminal block. One suitable fuse block is the Buss #R25030-1PR fuse block having a 30 amp fuse that prevents circuit overload. Of course, one of skill in the art would understand that other components not specifically listed herein would also work. A central processing unit (CPU) activates each valve assembly through the relay 96.

The standoffs 90 connect the intermediate enclosure 12 to the support housing 10 by way of a threadable engagement. The intermediate enclosure is preferably formed as a weldment, such as from 6061 Aluminum, but may also be a casting, e.g., A356 cast aluminum. It should be understood that the intermediate enclosure could also be formed from hard plastic, for example by molding.

Figure 9:
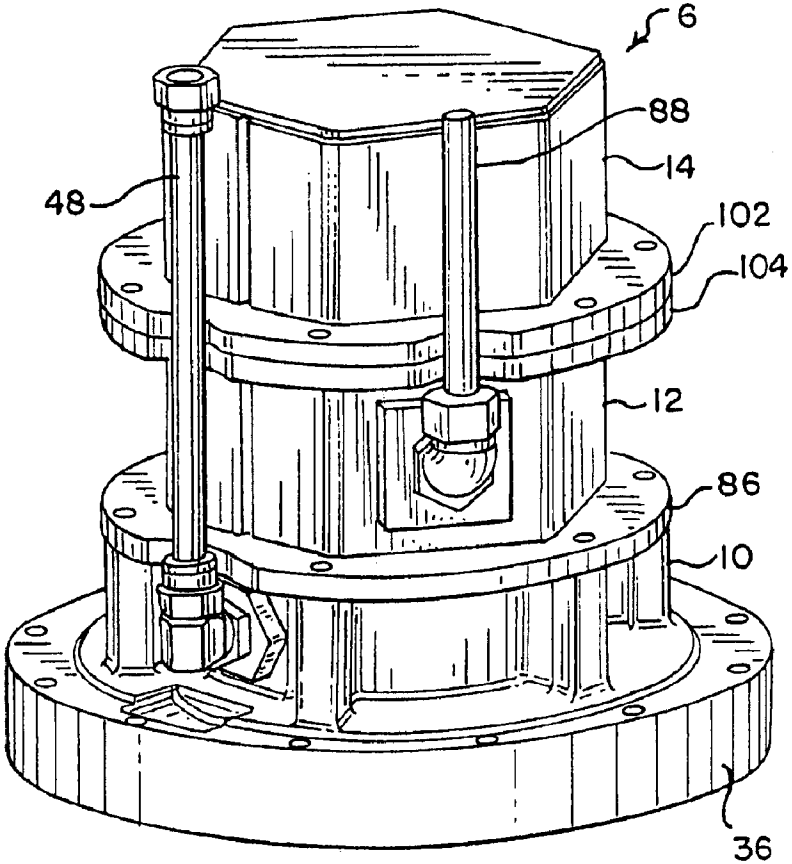
FIG. 9 is a bottom perspective view of the spray housing.
Figure 8:
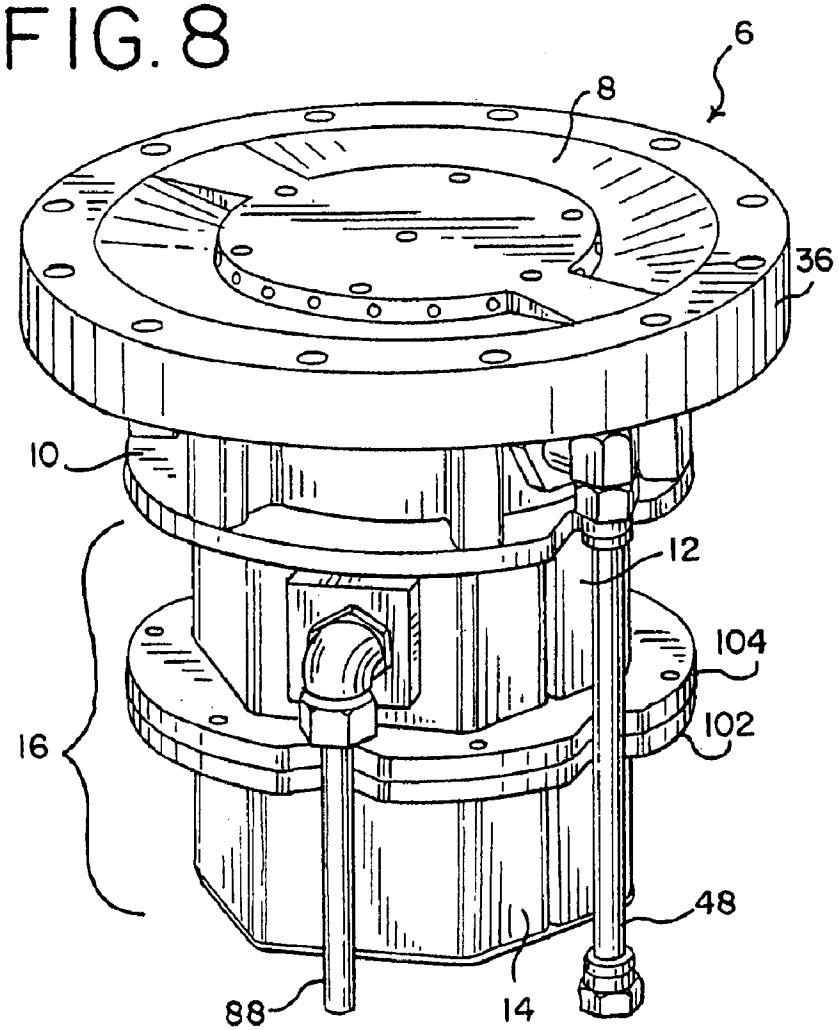
FIG. 8 is a top perspective view of the spray housing.

Referring to FIGS. 1, 8 and 9, the end enclosure 14 is connected to and sealed against the bottom of the intermediate housing and completes the spray housing. The end enclosure 14 surrounds the control components. A seal 100, preferably a #2-263 o-ring, is received in a groove 106 formed in a flange 104 in the bottom of the intermediate enclosure and seals against a flange 102 of the end enclosure in a watertight relationship. The end enclosure is secured to the intermediate enclosure 12 by way of a plurality of fasteners (shown as 6). The spray housing 6 is watertight and protects the various valves and electrical components from the outside environment. The end enclosure 14 is preferably formed as a weldment or casting, for example from one or more of the above-described materials, although it can also be formed from hard plastic.

It should be understood that the spray housing, with all of its components, can be formed as a single integral member. Alternatively, the support housing and control housing, including the intermediate and end enclosures, can be formed as a single integral unit. In yet another alternative, the intermediate and end enclosures can be formed as a single integral unit. It should also be understood that the various spray housing components, when made as separate components, can be secured one to the other with various mechanical fasteners, clamps, bonding/adhesives, snap-fit devices, tabs, etc.

Figure 11:
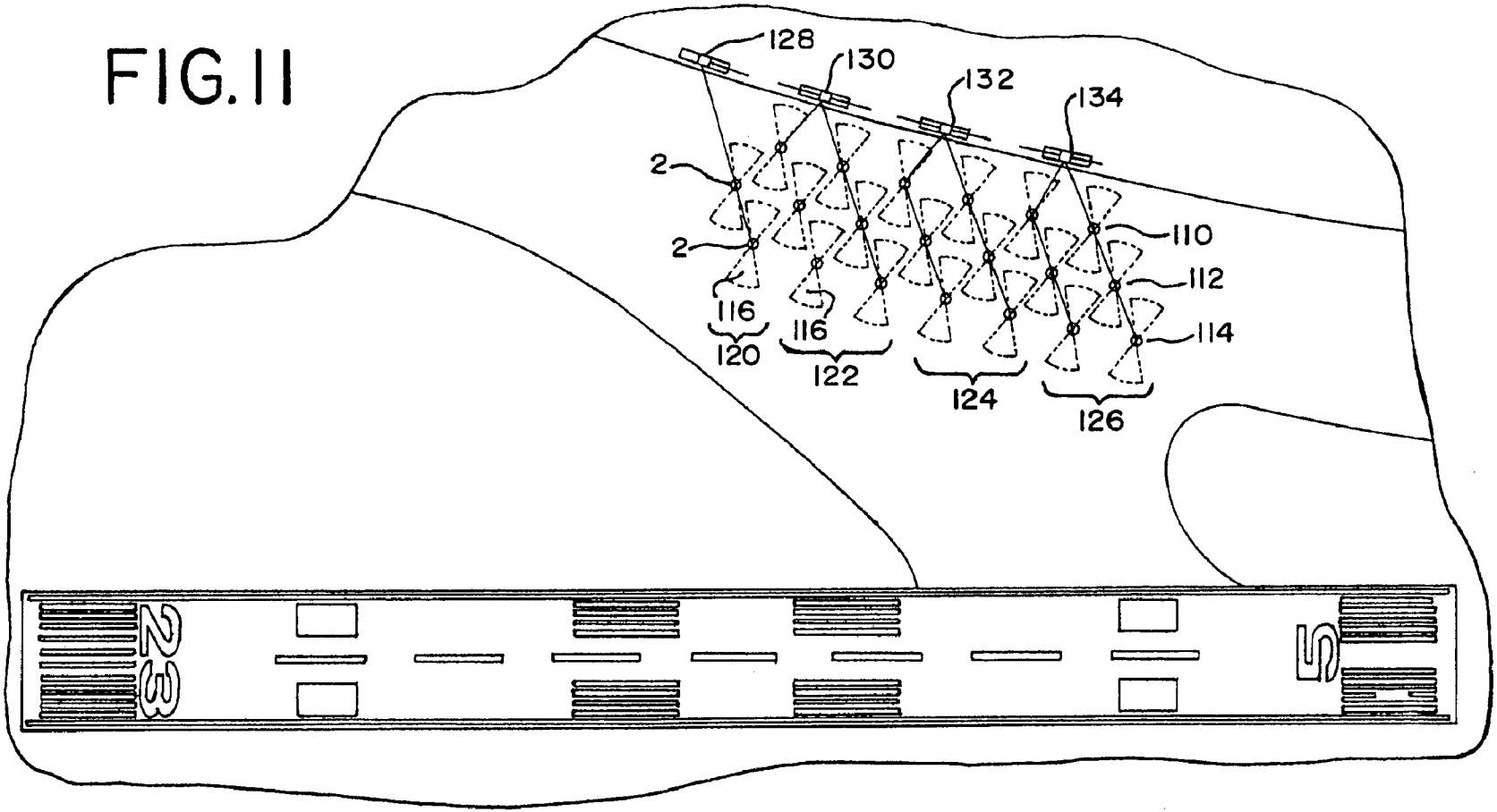
FIG. 11 is a plan view of an exemplary anti-icing system installed on an airport taxiway.

Referring to FIG. 11, one embodiment of an anti-icing system is shown as having a plurality of anti-icing assemblies 2 disposed in a roadway 20. In particular, a plurality of base housings are mounted in the roadway beneath the surface thereof. A plurality of spray housing units are then connected to the fluid and electrical conduits in each of the base housings and are removably secured to the base housings. Each spay unit preferably includes a spray housing, one or more valve assemblies and a control assembly. Since the spray housing is modular, meaning that it has been shaped and adapted for installation in an existing, FAA approved light base housing, the spray unit can be easily and quickly installed without concern for the foundation thereof. Of course, however, it should be understood that the base housing is not limited to FAA approved light base housings. In addition, the components, and in particular the electrical and valve components, are sealed within the watertight spray housing such that they cannot be damaged by water.

In addition, the entire spray unit can be easily removed if it is damaged or malfunctions and another unit installed therein without having to trouble-shoot any problems on site. The unit can then be serviced at a remote, environmentally controlled location. In this way, maintenance and troubleshooting is greatly improved and facilitated.

The plurality of spray units can be centrally controlled by an operator, who can activate one or more of the units by way of the CPU, or even the individual valves in each unit, depending on the conditions of the roadway. In particular, the control system opens the valve(s), which permits the flow of anti-icing agent through the spray outlet and onto the roadway. Various sensors can be provided in or adjacent to the roadway to provide the operator with information about the conditions of the roadway. For example, various sensors available from Surface Systems Inc. (SSI), a Quixote Company located at 11612 Lilburn Park Road, St. Louis, Mo., 63146, can be deployed to provide accurate, timely weather information. In one embodiment, the Road Weather Information System available from SSI can include the FP 2000® Surface Sensor, the SSI Sub Surface Temperature Probe, the Thies Air Temperature/Relative Humidity sensor, the R. M. Young wind speed/direction sensor, video imaging cameras and visibility sensors. The sensors can be connected to remote processing units, which in turn are connected to the central processing location. A suitable surface sensor is further disclosed in U.S. Pat. No. 4,897,597, which is hereby incorporated herein by reference.

Alternatively, the system can be automated, with a central computer (CPU) receiving information from the sensors and automatically activating one or spray units depending on the data collected from the sensors. For example, the CPU can energize the solenoid valve by way of the relay. In either embodiment, the need for snow removal is greatly reduced since the spray systems can be activated to prevent ice from forming on the adjacent roadway. In this way, and for example, the number of runway incursions at an airport can be greatly reduced.

As shown in FIG. 11, the system of spray units can be arranged in predetermined grid or pattern to maximize the spray coverage of the system. For example, rows 110, 112, 114 of the units can be staggered such that fan-shaped spray patterns 116 extending from opposite sides of each unit are nested to substantially cover the entire surface roadway 20. One or more units can be coupled with the fluid and electrical conduits, for example along adjacent diagonals, which extend between and communicate with the various units, to form sectors 120, 122, 124, 126 of units. Each sector can be supplied by a reservoir 128, 130, 132, 134 of pressurized anti-icing agent positioned off of the roadway. Alternatively, a pump can be used to supply the fluid to the spray units through the conduit. Of course, the entire system can be supplied from a single reservoir. In addition, the sectors can be individually activated or controlled, depending on the road conditions in that sector.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. An anti-icing spray assembly comprising:

a base housing having a generally open top and a cavity, wherein said base housing is adapted to be mounted in a roadway;

a spray housing removably secured to said base housing with at least a portion of said spray housing being disposed in said cavity of said base housing, said spray housing defining an interior chamber, wherein said spray housing is watertight so as to substantially prevent water from entering said interior chamber, and wherein said spray housing comprises at least one spray outlet adapted to spray an anti-icing agent onto the roadway; and at least one valve assembly disposed in said interior chamber of said spray housing, said at least one valve assembly operably connected to said at least one spray outlet, said at least one valve assembly moveable between a closed position and an open position, wherein said at least one valve assembly is adapted to permit the flow of the anti-icing agent through said at least one spray outlet and onto the roadway when moved to said open position.

2. The anti-icing spray assembly of claim 1 wherein said spray housing comprises at least two spray outlets oriented in opposite directions.

3. The anti-icing spray assembly of claim 1 wherein said spray housing comprises a spray plate defining said at least one spray outlet.

4. The anti-icing spray assembly of claim 3 wherein said spray housing further comprises a support housing having a recess shaped to receive said spray plate, wherein said support housing is removably mounted to said base housing.

5. The anti-icing spray assembly of claim 4 wherein said support housing comprises an annular flange fitting over and secured to said top of said base housing.

6. The anti-icing spray assembly of claim 4 wherein said spray housing further comprises a control housing secured to said support housing in a watertight relationship, wherein said at least one valve assembly is positioned in said control housing.

7. The anti-icing spray assembly of claim 6 wherein said control housing comprises an intermediate enclosure secured to said support housing and an end enclosure secured to said intermediate enclosure.

8. The anti-icing spray assembly of claim 6 further comprising an electrical control system disposed in said control housing and operably connected to said at least one valve assembly.

9. The anti-icing spray assembly of claim 8 wherein said electrical control system comprises at least one electrical relay.

10. The anti-icing spray assembly of claim 1 wherein said base housing comprises an FAA approved L-868 light base housing.

11. An anti-icing spray system comprising:

a roadway having a surface;

a plurality of anti-icing spray assemblies each comprising a base housing, a spray housing and at least one valve assembly, wherein each of said plurality of base housings has a generally open top and a cavity and wherein said plurality of base housings are installed in said roadway so as to not protrude above said surface thereof, wherein each of said spray housings are removably secured to a corresponding one of said base housings with at least a portion of each of said spray housings being disposed in said cavity of said corresponding one of said base housings, said spray housings each defining an interior chamber, wherein each of said spray housings is watertight so as to substantially prevent water from entering said interior chamber thereof, wherein each of said spray housings comprises at least one spray outlet, and wherein each of said at least one valve assemblies is disposed in said interior chamber of a corresponding one of said spray housings, each of said at least one valve assemblies operably connected to a corresponding one of said at least one spray outlet; and a fluid conduit communicating with each of said spray housings and operably connected to said at least one valve assembly disposed therein, said fluid conduit supplying an anti-icing agent to said respective spray assemblies, wherein each of said at least one valve assemblies is moveable between a closed position and an open position, wherein each of said at least one valve assemblies permits the flow of said anti-icing agent through said corresponding one of said at least one spray outlets and onto the roadway surface when moved to said open position.

12. The anti-icing spray system of claim 11 wherein at least some of said plurality of said spray housings comprises at least two spray outlets oriented in opposite directions.

13. The anti-icing spray system of claim 11 wherein each of said spray housings comprises a spray plate defining said at least one spray outlet.

14. The anti-icing spray system of claim 13 wherein each of said spray housings further comprises a support housing having a recess shaped to receive said spray plate, wherein said support housing is removably mounted to said corresponding one of said base housings.

15. The anti-icing spray system of claim 14 wherein each of said support housings comprises an annular flange fitting over and secured to said top of said corresponding one of said base housings.

16. The anti-icing spray system of claim 14 wherein each of said spray housings further comprises a control housing secured to a corresponding one of said support housings in a watertight relationship, wherein said corresponding one of said at least one valve assemblies is positioned in a corresponding one of said control housings.

17. The anti-icing spray system of claim 16 wherein each of said control housings comprises an intermediate enclosure secured to a corresponding one of said support housings and an end enclosure secured to said intermediate enclosure.

18. The anti-icing spray system of claim 16 further comprising an electrical control system disposed in each of said control housings and operably connected to a corresponding one of said at least one valve assemblies, wherein each of said electrical control systems is operable to move a corresponding one of said at least one valve assemblies between said closed and open positions.

19. The anti-icing spray system of claim 18 wherein each of said electrical control systems comprises at least one electrical relay.

20. The anti-icing spray system of claim 11 wherein at least some of said base housings comprises an FAA approved L-868 light base housing.

21. The anti-icing spray system of claim 11 wherein said plurality of said anti-icing spray assemblies are arranged in a predetermined spray grid.

22. A method of installing an anti-icing spray system in a roadway comprising:

installing a plurality of base housings in said roadway such that said base housings do not protrude above a surface thereof, wherein each of said plurality of base housings has a generally open top and a cavity;

inserting a plurality of spray housings into corresponding ones of said base housings, with at least a portion of said spray housings being received in said cavities of said corresponding ones of said base housings; and removably securing said plurality of spray housings to said corresponding ones of said base housings, wherein each of said spray housings defines an interior chamber and is watertight so as to substantially prevent water from entering said interior chamber, wherein each of said spray housings comprises at least one spray outlet and at least one valve assembly disposed in said interior chamber thereof and operably connected to said at least one spray outlet.

23. The method of claim 22 further comprising connecting a fluid conduit to each of said spray housings, wherein said fluid conduit supplies an anti-icing agent to each of said respective spray housings.

24. The method of claim 22 wherein at least some of said plurality of said spray housings comprises at least two spray outlets oriented in opposite directions.

25. The method of claim 22 wherein each of said spray housings comprises a spray plate defining said at least one spray outlet.

26. The method of claim 25 wherein each of said spray housings further comprises a support housing having a recess shaped to receive said spray plate, and wherein said removably securing said plurality of spray housings to said corresponding ones of said base housings comprises removably securing said support housings to said corresponding ones of said base housings.

27. The method system of claim 26 wherein each of said support housings comprises an annular flange, and wherein said removably securing said support housings to said corresponding ones of said base housings comprises fitting said annular flange of each of said support housings over said top of said corresponding ones of said base housing and securing said annular flange to said top.

28. The method of claim 26 wherein each of said spray housings further comprises a control housing secured to said support housing in a watertight relationship, wherein a corresponding one of said valve assemblies is positioned in said control housing.

29. The method of claim 28 wherein each of said control housings comprises an intermediate enclosure secured to a corresponding one of said support housings and an end enclosure secured to said intermediate enclosure.

30. The method of claim 28 further comprising providing an electrical control system disposed in each of said control housings and operably connected to said corresponding one of said valve assemblies, wherein said electrical control system is operable to move said corresponding one of said valve assemblies between closed and open positions.

31. The method of claim 30 wherein each of said electrical control systems comprises at least one electrical relay.

32. The method of claim 22 wherein at least some of said plurality of said base housings comprises an FAA approved L-868 light base housing.

33. The method of claim 22 further comprising connecting an electrical conduit to each of said spray housings, wherein said electrical conduit supplies electrical power to said respective spray housing.

* * * * *